US006616780B1

(12) United States Patent
Mahood

(10) Patent No.: US 6,616,780 B1
(45) Date of Patent: Sep. 9, 2003

(54) METHOD AND DEVICE FOR SUPPLYING LABELS TO LABELING DEVICE

(75) Inventor: Bradley J. Mahood, London (CA)

(73) Assignee: Labatt Brewing Company Limited, London (CA)

( * ) Notice: Subject to any disclaimer, the term of this patent is extended or adjusted under 35 U.S.C. 154(b) by 0 days.

(21) Appl. No.: 09/632,204

(22) Filed: Aug. 2, 2000

Related U.S. Application Data

(60) Provisional application No. 60/149,291, filed on Aug. 18, 1999.

(51) Int. Cl.[7] ..... B65B 69/00

(52) U.S. Cl. ..... 156/60; 156/DIG. 1; 414/810; 221/291

(58) Field of Search ..... 156/391, 538–540, 156/558, 564–568, 570, 571, 573, 575, DIG. 28, DIG. 29, DIG. 30, 60, DIG. 1; 221/93, 95, 103–107, 112, 119, 121, 123, 133, 174, 197–198, 312 B, 312 C, 291; 414/405, 19, 798.5–798.7, 799, 404, 331.02, 223.02, 403, 810, 621, 771, 769

(56) References Cited

U.S. PATENT DOCUMENTS

| | | | | |
|---|---|---|---|---|
| 3,889,846 A | * | 6/1975 | Strack | 221/79 |
| 4,445,951 A | | 5/1984 | Lind et al. | 156/93 |
| 4,445,961 A | | 5/1984 | Kronseder et al. | 156/364 |
| 4,478,668 A | | 10/1984 | Gau | 156/364 |
| 4,478,688 A | | 10/1984 | de Hek | 204/11 |
| 4,512,842 A | | 4/1985 | Schneider | 156/357 |
| 5,024,717 A | | 6/1991 | Winter | 156/354 |
| 5,116,452 A | | 5/1992 | Eder | 156/566 |
| 5,215,622 A | | 6/1993 | Schmelzer | 156/566 |
| 5,290,388 A | | 3/1994 | Zepf | 156/447 |
| 5,429,471 A | * | 7/1995 | Roccabella | 198/399 |
| 5,464,495 A | | 11/1995 | Eder | 156/456 |
| 6,213,707 B1 | * | 4/2001 | Liehs et al. | 414/405 |

* cited by examiner

*Primary Examiner*—Richard Crispino
*Assistant Examiner*—Sing P. Chan
(74) *Attorney, Agent, or Firm*—Levy & Grandinetti

(57) ABSTRACT

A method and a device are disclosed for supplying a plurality of labels to a labeling device. The device includes a carton containing a stack of labels. The labels are packaged in the carton with the top ends of the labels adjacent to a bottom wall of the carton and the bottom ends of the labels are positioned at an open top end of the carton. A feed carriage of the labeling device is filled by inverting and positioning the carton on the feed carriage with the open end facing the bottom wall of the feed carriage. The carton is then removed from the feed carriage, leaving the labels on the feed carriage in an upright position. The feed carriage is then delivered to the labeling device for applying the labels to the containers.

8 Claims, 2 Drawing Sheets

METHOD AND DEVICE FOR SUPPLYING LABELS TO LABELING DEVICE

I claim the benefit under Title 35, United States Code, §120 to U.S. Provisional application No. 60/149,291, filed Aug. 18, 1999, entitled METHOD AND DEVICE FOR SUPPLYING LABELS TO LABELING DEVICE.

BACKGROUND OF THE INVENTION

1. Field of the Invention

The present invention relates to a method and a container for a label magazine device for supplying labels to a labeling machine. More particularly, the invention relates to a method and label magazine device for supplying labels to a feeding device of a labeling machine.

2. Description of the Background Art

Labeling machines, having various stations for applying labels of different sizes to a container, are known in the art. These machines generally have a station for applying glue or other adhesive to the label and a magazine from which the labels are removed and transferred to the container. The machines also have a member for brushing over the container to press the label onto the container. The containers are carried to a rotary table, which moves them through a circular path. Each container goes onto a rotary plate that is driven to rotate the container about the vertical axis at appropriate times as it proceeds in a circular path. A gripper element grips a label from the magazine and applies the label to the container as the container is rotated past the labeling station. This type of device is suitable for applying labels of a normal size to containers such as beverage bottles.

Labeling machines generally have a magazine or other holder of labels, which can supply the labels one at time to the label-applying device. One example of a magazine for a labeling device includes a tray that can continuously feed the labels to the labeling machine. These label trays can hold large numbers of the labels in a stack and continuously supply the labels to the labeling device. When the supply of labels in the tray is depleted, the tray is ejected and a full tray of labels is fed to the machine to provide a continuous supply of labels. However, a disadvantage of this type of device is that the trays must be filled manually, thereby increasing the labor involved in operating the labeling machine.

Typically, labels are printed and cut by a label manufacturer and the shipped to an end user's packaging plant where the labels are applied to the end user's articles or containers. The preprinted labels are generally stacked and bundled together with tape or bands. The bands must be cut and removed from the stacks of labels before the labels can be placed into labels feeding device.

Examples of labeling machines with label magazines and/or trays are disclosed in the following patents. Numerous other examples of this art exists.

U.S. Pat. No. 4,445,961 to Kronseder et al. discloses a labeling apparatus for bottles or the like. The device of this patent has a turret rotating on a fixed axle. The turret has circumferentially spaced apart curved glue pallets, which pick up glue from a roller and then pick up a label. The label is deposited on a cylinder such as a bottle. The labels are held as a "label stack" in a container.

U.S. Pat. No. 4,478,668 to Gau discloses a labeling machine. The device of this patent has a rotor on which several oscillatingly driven pallet shafts are supported. Glue pallets both contact glue and a label in label stack comparable to that disclosed for the '961 patent described above.

Accordingly there is a continuing need in the industry for an improved method and device for supplying the labels to a labeling machine.

SUMMARY OF THE INVENTION

The invention is a method and device for attaching a label to a container. The method includes providing a carton having at least two side walls, a bottom wall, first and second longitudinal ends, and an open top end. The carton contains a plurality of labels arranged in a stack extending from the first end to the second end. The labels have a top end and a lower end and are arranged in the carton whereby the top end of the label is adjacent the bottom wall and the lower end is at the open top end of the carton. The method then includes placing the carton on a feed carriage of a labeling device in an inverted position whereby the lower end of the labels are on a bottom wall of the carriage and the labels are in an upright position. The next step is feeding the labels to the labeling device. Then the step of applying the labels to the container is performed.

The device of this invention performs the invented method.

BRIEF DESCRIPTION OF THE DRAWINGS

The following is a brief description of the drawings, which form a part of the disclosure of the invention.

DETAILED DESCRIPTION OF THE INVENTION

Figure 1:
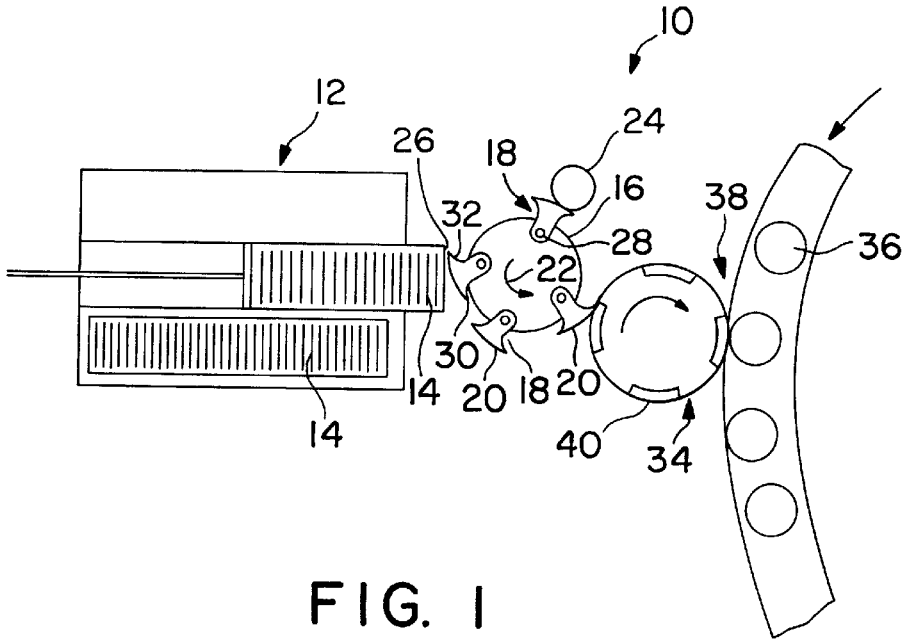
FIG. 1 is a schematic view of a labeling machine in one embodiment of the invention.

The invention is directed to a method for filling a supply magazine of a labeling machine and to a device for feeding labels to a labeling device and applying the labels to containers. A primary object of the invention is to provide plurality of labels packaged in a carton that can be easily transferred to a labeling device.

The invention includes a method for supplying a stack of labels to a labeling machine where a carton of the labels is positioned on a feed carriage of a labeling device with the open top end of the carton on a bottom wall of the carriage. The carton is then removed from the feed carriage to transfer the labels from the carton to the feed carriage with the labels in the normal upright position. The feed carriage can then be placed in labeling device to feed the labels into the labeling device for applying the labels to containers.

A further aspect of the method of the invention can include supplying a stack of labels to a labeling machine by providing a carton of the labels and positioning a label magazine on the carton and inverting the carton and label magazine to transfer the labels from the carton to the magazine. The carton is then removed from the magazine and the magazine is placed in the labeling machine for supplying the labels to the labeling device.

The device of the invention includes a carton containing a plurality of labels where the labels are oriented in the carton in an inverted position with respect to the normal upright position of the labels. The carton generally has a pair of side walls and end walls with an open top end. The labels are arranged in a stack extending from one end wall to the other end wall. The labels are packaged in the carton with the top end of the labels adjacent the bottom wall of the carton and the bottom end of the labels at the open top end of the carton.

The method and device of the invention are primarily directed to automated filling machines and labeling machines for applying labels to a container. The containers can be, for example, bottles or cans. Referring to the drawings, the invention is used in connection with a labeling machine of the type having an automatic magazine for, providing a continuous supply of labels to the label-applying device. In a preferred embodiment of the invention, the labeling machine maintains a continuous production of labeled containers.

FIG. 1 illustrates a labeling machine 10. The labeling machine 10 includes a label carriage 12 for containing a plurality of labels 14 in a stacked array. The label carriage 12 feeds the labels 14 to a turntable 16. The turntable 16 has a plurality of pick-up arms 18 that are pivotally mounted on the turntable 16. Each of the pick-up arms 18 has a curved outer face 20. Each curved outer face 20 rotates in the direction of the arrow 22 over a glue roller 24 to apply an amount of glue to the curved outer face 20 of the pick-up arms 18. The turntable 16 rotates to carry the glue-covered pick-up arms 18 to the label carriage 12 where the curved outer face 20 contacts the outermost label 26 of the stack of labels 14 in the label carriage 12. The curved outer surface 20 of the pick-up arms 18 transfers the adhesive to the bottom face of a single one of the labels 14. The adhesive also enables the pick-up arms 18 to "pick up" or remove a single label from the stack of labels 14 in the label carriage 12.

The pick-up arms 18 are mounted on the turntable 16 to pivot about the pivot pin 28 and are pivoted generally in the direction of rotation of the turntable 16. The pick-up arms 18 are oscillated as the pick-up arms 18 roll over the glue roller 24 and the label carriage 12 by a series of cam members or by pneumatic mechanisms (not shown) as known in the art of labeling machines. The pick-up arms 18 assume a normal position with the leading edge 30 of the curved outer face 20 closest to the turntable 16 and the trailing edge 32 of the pick-up arms 18 pivoted to an outward position as the pick-up arms 18 approach the glue roller 24 and the label carriage 12. The pick-up arms 18 are thus able to roll over the glue roller 24 to pick up a predetermined amount of glue and to roll over the exposed face of the outermost label 26 in the stack of the labels in the label carriage 12 and pick up a single label from the stack. The oscillating mechanism of the pick-up arms 18 returns the arms to their original position after contacting the glue roller 24 and the label carriage 12.

The turntable 16 continues to rotate and carries the pick-up arms 18 to a transfer drum 34. The oscillating movement of the pick-up arms 18 causes the pick-up arms 18 to pivot forward in the direction of rotation of the turntable 16 substantially, immediately after the arms pass the stack of labels in the label carriage 12. The curved outer face 20 of the pick-up arms 18 contacts the transfer drum 34 where the transfer drum 34 separates the label from the pick-up arms 18 and carries the label to the container 36 in a label applying location 38. The transfer drum 34 includes a plurality of label pick-up or gripping devices 40 for separating the labels from the pick-up arms 18 and carrying the labels to a container 36.

A conveyor 42 carries a continuous supply of containers 36 through the label applying location 38 where the transfer drum 34 contacts the containers 36. The gripping device 40 on the transfer drum 34 applies the labels to the side of the containers 36. Examples of suitable labeling machines, which can be used with the invention, are disclosed in U.S. Pat. No. 4,512,842, U.S. Pat. No. 4,445,961, and U.S. Pat. No. 4,478,668, which are hereby incorporated by reference in their entirety.

Figure 2:
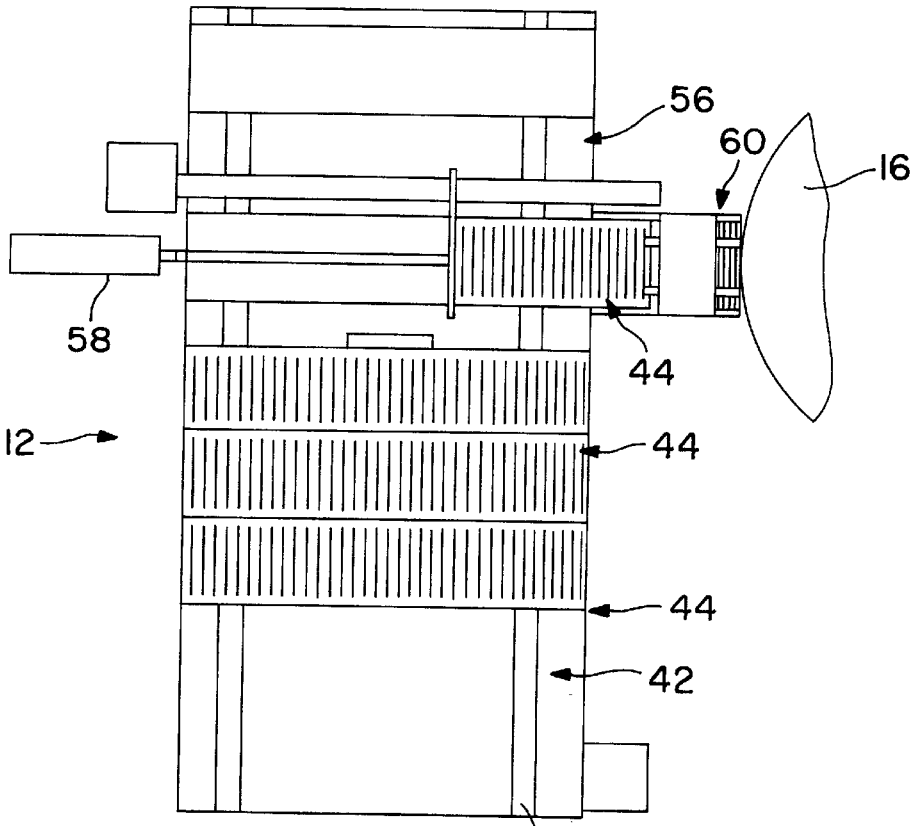
FIG. 2 is a top view of the label carriage of the labeling machine in an embodiment of the invention.

FIG. 2 illustrates the label carriage 12. The label carriage 12 supplies a label to the pick-up turntable 16. The label carriage 12 includes a label magazine 44 containing a stack of labels in an array.

Figure 3:
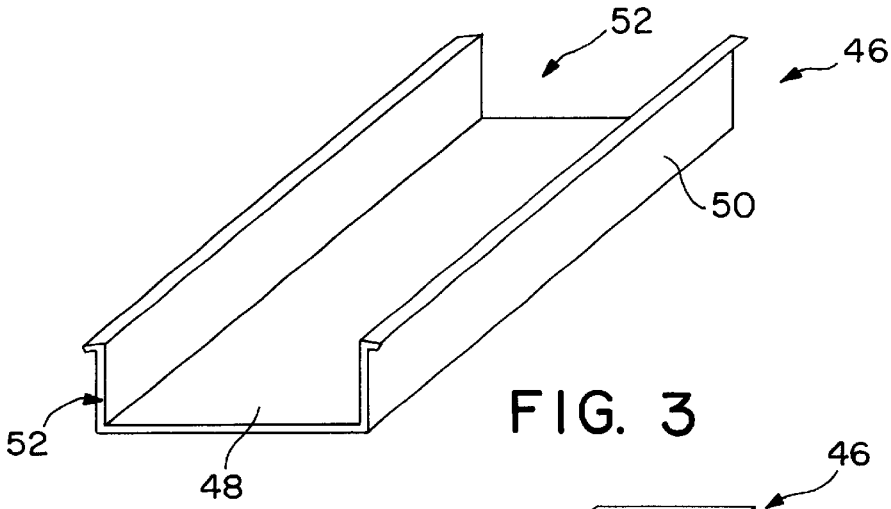
FIG. 3 is a perspective view of a label magazine in the embodiment of FIG. 1.

FIG. 3 illustrates the label magazine 44. The label magazine 44 generally includes a tray-like device 46 having a bottom wall 48 and a pair of sidewalls 50. The label magazine 44 in the preferred embodiment has open longitudinal ends 52 for allowing the labels to be pushed out of the end of the label magazine 44 and picked up by the turntable 16. The labels 14 are placed in the label magazine 44 with the bottom face of the labels facing toward the turntable 16 and with the printed surface facing away from the turntable 16. The labels are also positioned in the label magazine 44 in the normal upright position with respect to the label.

The label carriage 12 includes a conveyor 54 for receiving a plurality of the label magazines 44 filled with the labels to be applied to the containers. The label magazines 44 are conveyed toward the feed end 56 of the label carriage 12 where the leading magazine engages a stop member. A pneumatically operated plunger 58 extends outward to push the stack of labels toward the supply end 60 of the label carriage 12 where the bottom surface of the labels are in a position to be picked up by the turntable 16. The turntable 16 rotates the pick-up arms 18 past the labels where the labels are picked up and carried to the label applying location 38. When the stack of labels in the label magazine 44 is depleted, the stop member is released to discharge the empty magazine. The conveyor 54 carries a full magazine to the feed position to provide a continuous supply of the labels for the label machine 10.

Figure 4:
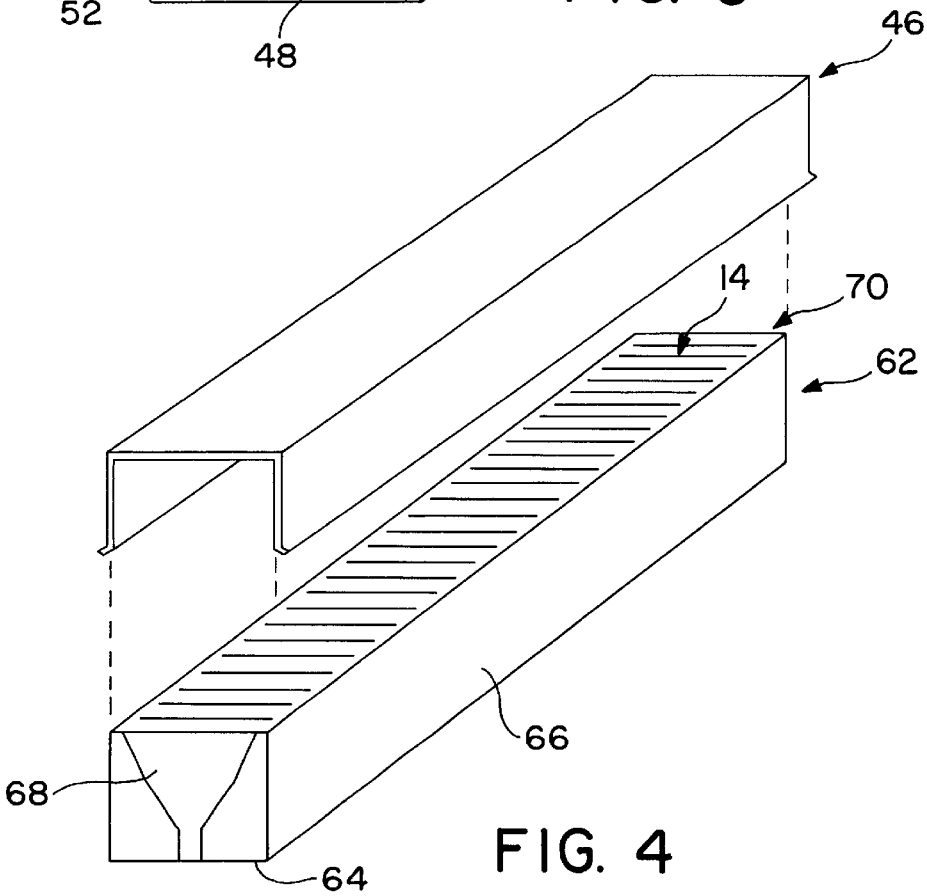
FIG. 4 is perspective view of the carton containing a plurality of the labels for filling the label magazine in one embodiment of the invention.

FIG. 4 illustrates the labels as the labels are initially supplied in cartons 62 having a bottom wall 64, sidewalls 66, and end walls 68. In preferred embodiment of the invention, the carton 62 has an open top end 70. In alternative embodiments, the carton 62 can have a top wall (not shown) to close the carton during shipping where the top wall can be removed before use as discussed below in greater detail. Generally, the carton 62 contains a plurality of the labels in a stacked array and can be banded or wrapped in shrink-wrap or similar packaging material.

Alternative embodiments of the invention include cartons having sidewalls attached by suitable attachment means. Suitable attachment means can include glue or the use of folds in the material to hold the cartons together. In this manner, a plurality of cartons can be loaded in a single procedural step into the label carriage 12 of FIG. 2.

Alternative embodiments of the invention also include label cartons having shapes that hold nonrectangular labels. Labels can appear in a variety of polygonal or other shapes. For example, parallelogram cartons are suitable for applying "neck labels" at an angle on the neck of a beverage bottle.

The labels 14 are, preferably, provided in the carton 62 in an inverted position with respect to the normal upright position of the labels 14. In this manner, the top end of the labels is positioned to rest against the bottom wall 64 of the carton 62 and the bottom end of the label is positioned at the open top end 70 of the carton 62.

The method of the invention fills the label magazine 44 by placing the empty magazine in an inverted orientation on the carton 62 so that the pair of sidewalls 50 of the label magazine 44 enclose the carton 62 of labels as shown in FIG. 4. The carton 62 and the label magazine 44 are then inverted together to the normal upright or operable position. The labels, which were originally in the carton in an inverted position, are now in the upright position in the label magazine 44. The carton is then lifted and separated from the label magazine 44 and the label magazine 44 is placed on the conveyor to be carried to the label supply position.

Figure 5:
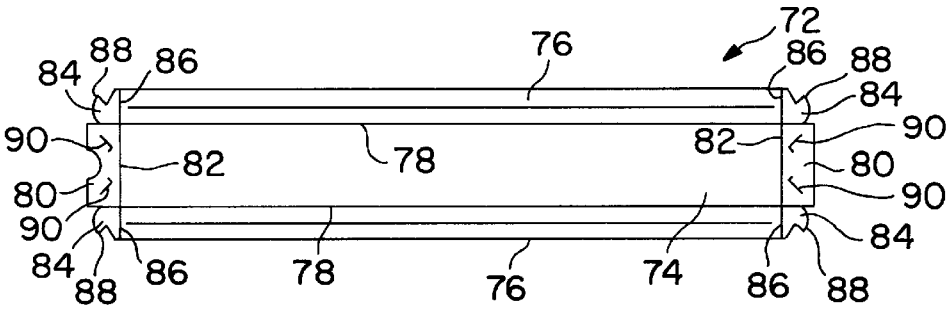
FIG. 5 is a top plan view of a blank for making a carton for containing the labels in a preferred embodiment of the invention.

FIG. 5 illustrates a cardboard blank 72 or the preferred embodiment of carton 62. Carton 62 has a generally rectangular shape with a longitudinal dimension for receiving a stack of several hundred labels at a time. The carton 62 is preferable made from a cardboard blank 72, such as the blanks shown in FIG. 5. Other flexible sheet or web materials can be used for the carton 62. The cardboard blank 72 of FIG. 5 has a bottom panel 74, a pair of side panels 76 connected to the bottom panel 74 by fold lines 78 and end panels 80 connected to the bottom panel 74 by fold lines 82. A tab 84 is connected to each end of the pair of side panels 76 along a fold line 86. The tabs 84 include a hooked portion 88 to be inserted into a respective slot 90 in the end panels 80. The carton 62 is formed by folding the side panels and the end panels perpendicular to the bottom panel. The tabs are then inserted into the slots in the end panels to lock the side panels to the end panels.

A desirable method for supplying a stack of labels to a labeling device according to the invention includes the following steps. Providing a carton of labels wherein the carton has a pair of opposite side walls, first and second end walls, and an open top end. The labels are arranged in a stack extending from the first end wall to the second end wall. The labels have a top end adjacent the bottom wall of the carton and bottom end at the open top end. The invention then includes positioning the carton of labels onto a label magazine of a labeling machine. Inverting the carton and label magazine is performed to transfer the labels from the carton to the magazine. Positioning the magazine on a feed carriage of the labeling machine with the open top end of the carriage facing in an upright direction occurs.

Although various embodiments of the invention have been chosen to illustrate the invention, it will be understood by those skilled in the art that various modifications and changes can be made to the method and device of the invention without departing from the spirit and scope of the invention as defined in the appended claims.

What is claimed is:

1. A method for attaching individual labels to individual containers, comprising the steps of:

providing a carton having at least two side walls, a bottom wall, a first longitudinal end and a second longitudinal end, and an open top end, said carton containing a plurality of labels arranged in a stack extending from said first longitudinal end to said second longitudinal end, said labels having a top end and a lower end and being arranged in said carton whereby said top end of said labels is adjacent to said bottom wall and said lower end is adjacent to said open top end of said carton;

placing said carton on a feed carriage of a labeling device in an inverted position whereby said lower end of said labels is adjacent to a bottom wall of said carriage and said labels are in an upright position;

removing said carton from said feed carriage;

feeding said labels to said labeling device; and applying said individual labels to said individual containers.

2. The method of claim 1, further comprising feeding said labels from said feed carriage to a label-applying device.

3. The method of claim 1, wherein said carton includes longitudinal end walls.

4. The method of claim 3, wherein said carton comprises a tab extending from first and second ends of each of said sidewalls and is coupled to said end walls.

5. The method of claim 1, wherein said labeling device includes a label applying device for removing said labels from said feed carriage and applying said individual labels to said individual containers.

6. The method of claim 1, wherein said feed carriage comprises a label magazine and said method further comprises:

placing said carton in said label magazine;

transferring said labels to said magazine; and feeding said labels from said magazine to said labeling device.

7. The method of claim 1, wherein said feed carriage includes a label magazine having a bottom wall, a pair of side walls and open ends, said method further comprises:

placing said label magazine in an inverted position over said open top end of said carton of said labels; and inverting said carton and uprighting said label magazine together to transfer said labels to said label magazine.

8. A method for supplying a stack of labels to a labeling device comprising the steps of:

providing a carton of labels, said carton has a pair of opposite side walls, a bottom wall, first and second end walls, and an open top end, said labels being arranged in a stack extending from said first end wall to said second end wall, said labels having a top end adjacent said bottom wall of said carton and a bottom end at said open top end of said carton;

placing said carton of labels in a label magazine of a labeling machine;

inverting said carton in said label magazine to transfer said labels from said carton to said magazine;

removing said carton from said label magazine; and positioning said magazine on a feed carriage of said labeling machine with an open top end of said magazine facing in an upright direction.

* * * * *